US005284269A

United States Patent [19]

Petrie et al.

[11] Patent Number: 5,284,269

[45] Date of Patent: Feb. 8, 1994

[54] SPACE SAVING DOUBLE SEAL

[76] Inventors: Jack G. Petrie, 3031 Longs Peak Rt., Estes Park, Colo. 80517; John R. Mulkey, 3858 W. 102nd Ave., Westminster, Colo. 80030

[21] Appl. No.: 84,536

[22] Filed: Jun. 28, 1993

[51] Int. Cl.[5] ..... B65D 88/46

[52] U.S. Cl. ..... 220/224; 220/222; 220/221

[58] Field of Search ..... 220/216, 221, 222, 224, 220/225

[56] References Cited

U.S. PATENT DOCUMENTS

| | | | |
|---|---|---|---|
| 2,536,019 | 1/1951 | Allen | 220/224 |
| 2,855,122 | 10/1958 | Ulm et al. | 220/224 |
| 2,888,161 | 5/1959 | Springer | 220/224 |
| 2,897,998 | 8/1959 | Ulm | 220/224 |
| 3,565,279 | 2/1971 | Joor | 220/224 |
| 4,308,968 | 1/1982 | Thiltgen et al. . | |
| 4,811,859 | 3/1989 | Kinghorn, Jr. | 220/224 |
| 5,036,995 | 8/1991 | Wagoner | 220/224 |

FOREIGN PATENT DOCUMENTS

| | | | |
|---|---|---|---|
| 2358636 | 7/1974 | Fed. Rep. of Germany | 220/224 |
| 1257563 | 2/1961 | France | 220/224 |

*Primary Examiner*—Allan N. Shoap
*Assistant Examiner*—S. Castellano
*Attorney, Agent, or Firm*—Rick Martin

[57] ABSTRACT

The space saving double seal uses a lower shoe, an upper shoe and a pair of vapor barriers joining them to a conventional outer rim plate on a floating roof. The secondary vapor barrier extends from the outer rim plate to the top of the upper shoe. A pair of pusher springs maintain the shoes against the tank's inner wall. The invention provides for liquid storage to the full height which the floating roof allows.

7 Claims, 6 Drawing Sheets

SPACE SAVING DOUBLE SEAL

FIELD OF INVENTION

The present invention relates to a double seal for a floating roof of a liquid storage tank such as a gasoline storage tank, wherein a double shoe arrangement maximizes the height of the stored liquid in the tank.

BACKGROUND OF THE INVENTION

Increasingly stringent pollution standards have resulted in the standard practice of using a double seal arrangement in the space between a floating roof and the inner walls of a fuel storage tank. There exist many types of double seal arrangements for floating roofs. U.S. Pat. No. 4,308,968 (1982) to Thiltgen et al. discloses a primary vapor barrier bolted between the floating roof and a shoe which rides on the wall of the tank. A secondary seal comprises a flexible support arrangement mounted on the floating roof. The flexible support has flexible wipers pushing against the inner wall of the tank. The secondary seal projects about 24 inches above the primary seal. The disadvantage of this arrangement is that the storage tank loses 24 inches of its storage capacity.

FIG. 1 shows another commonly used arrangement. A floating roof 1 floats atop the liquid 10. A shoe 5 slides along the inner wall 4 of tank 2. The shoe 5 is pushed against the inner wall 4 by a pusher spring 6 which is mounted against the outer rim plate 7. Brace 8 helps support the shoe support 9. The shoe support 9 also pushes shoe 5 against inner wall 4. The volatile liquid 10 evaporates vapors 11 which are trapped by a primary seal comprising a shoe 5 and a primary vapor barrier 12. Primary vapors 11 create a saturated vapor space. Primary vapor barrier 12 is mounted between shoe 5 and outer rim plate 7. A compression plate 14 supports a secondary seal 13 against the inner wall 4. This arrangement satisfactorily seals in the secondary vapors 110.

However, the compression plate 14 rises a height h2 above the primary vapor barrier 12. The height from the liquid surface 16 to the tank top 15 is h1. The height h2 is lost for liquid storage purposes.

The present invention eliminates the lost storage height h2 while providing the same double seal protection shown in FIG. 1. It would not be effective to merely put a secondary vapor barrier parallel to the primary vapor barrier 12 and mounted to the shoe 5 and outer rim plate 7. Due to the irregular shape of the inner wall 4 there is often a vapor leak between shoe 5 and inner wall 4. Therefore, merely stringing another vapor barrier from shoe 5 to outer rim plate 7 would not capture any fumes from a vapor leak between inner wall 4 and shoe 5.

The present invention utilizes a double shoe arrangement with a primary and secondary vapor barrier extending to the outer rim plate.

SUMMARY OF THE INVENTION

It is the primary object of the present invention to provide a double seal floating roof closure to the inner wall of a tank wherein there is a minimal loss of storage height caused by the double seal.

Another object of the present invention is to provide a double shoe seal between a floating roof and an inner wall of a tank. This arrangement minimizes vapor leaks between the inner wall and the shoes.

Other objects of this invention will appear from the following description and appended claims, referenced being had to the accompanying drawings forming a part of this specification wherein like reference characters designate corresponding parts in the several views.

The present invention centers on a downward facing pusher brace depending from a conventional outer rim plate. This pusher brace supports a pair of vertical shoe support pusher springs for an upper and lower shoe. These shoes are slidingly engaged in a conventional manner with the inner wall of a tank. Any vapor leaks of the first shoe are caught by the second shoe above it. Vapor barriers are mounted between the top of each shoe and the outer rim plate.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE PREFERRED EMBODIMENT

Figure 2:
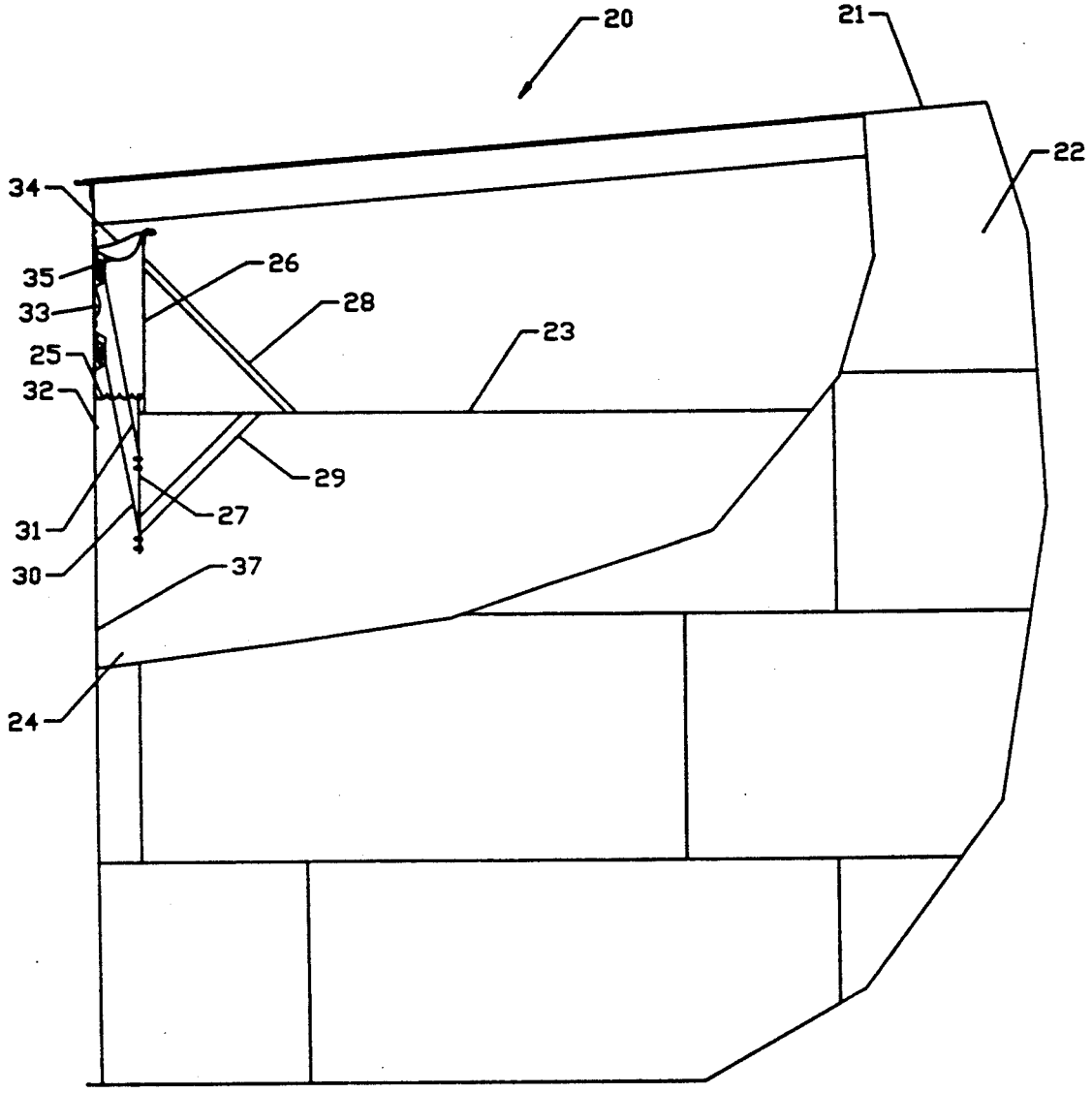
FIG. 2 is a front plan view of a storage tank with a partial cutaway showing the floating roof and the space saving double seal.

Referring first to FIG. 2 a tank 20 has a cylindrical outer wall 22, an inner wall 37 and a fixed roof 21. The stored liquid 24 has a top surface 25. A floating roof 23 has an outer rim plate 26. A downward extending pusher brace 27 is supported by brace 29.

Figure 1:
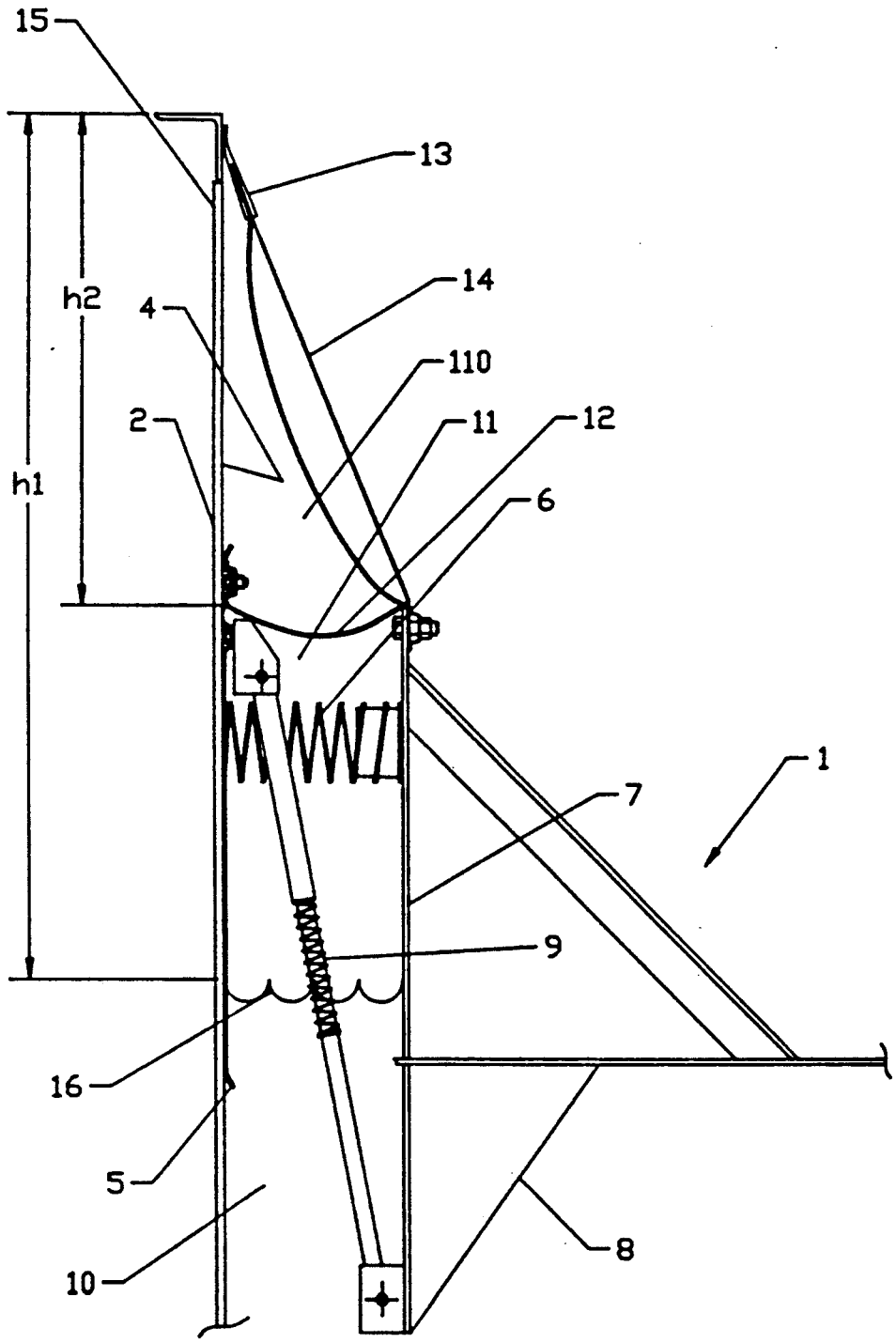
FIG. 1 (PRIOR ART)
FIG.1 (Prior Art) is a cross sectional view of a conventional dual seal assembly for a floating roof.

Lower shoe 32 is pushed against inner wall 37 by pusher spring 30. Upper shoe 33 is pushed against inner wall 37 by pusher spring 31. A primary seal assembly comprises the members lower shoe 32, and primary vapor barrier 35. Vapor barrier 35 extends from outer rim plate 26, in front of upper shoe 33 and finally attaches to the top of lower shoe 32. A secondary seal assembly comprises the members upper shoe 33 and vapor barrier 34 which extends between upper shoe 33 and outer rim plate 26. The height d1 of the lower shoe 32 ranges from 20 to 30 inches. The height d2 of the upper shoe ranges from 12 to 18 inches. The only lost storage height h10 is the height of the floating roof with its outer rim seal 26. This represents a storage savings over the prior art of FIG. 1 of about 24 inches.

Figure 3:
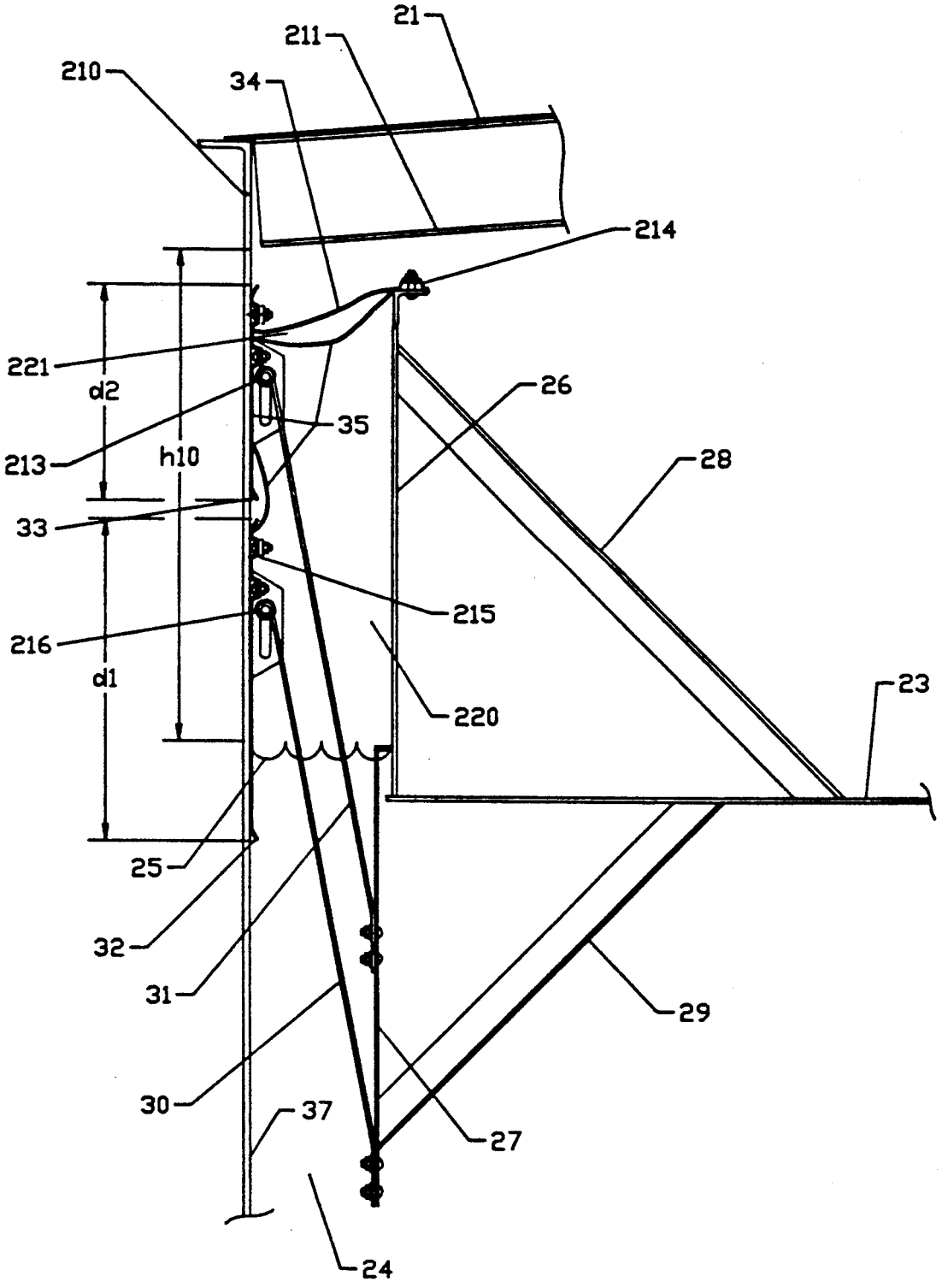
FIG. 3 is a cross sectional view of the space saving double seal applied to a pan type floating roof.

Referring next to FIG. 3 the invention of FIG. 2 is seen in better detail. The topmost level of the liquid bearing surface of the tank is shown at 210. The floating roof 23 with outer rim plate 26 cannot rise above level 210 because the top of outer rim plate 26 would abut roof support members 211.

Therefore, the height h10 is always lost as liquid storage space regardless of the sealing arrangement. The present invention provides a double seal arrangement without affecting the lost storage space height h10.

The primary vapor barrier 35 is attached to the top of the outer rim plate 26 by means of bolts 214. It then passes behind pusher spring mount 213 and is attached to the top of lower shoe 32 by means of bolts 215. Pusher spring 30 is attached to lower shoe 32 by means of pusher spring mount 216. The primary vapor space 220 becomes vapor saturated. The secondary vapor space 221 captures any leaks from the primary vapor space 220. The floating roof 23 supports an optional upper brace 28.

Figure 4:
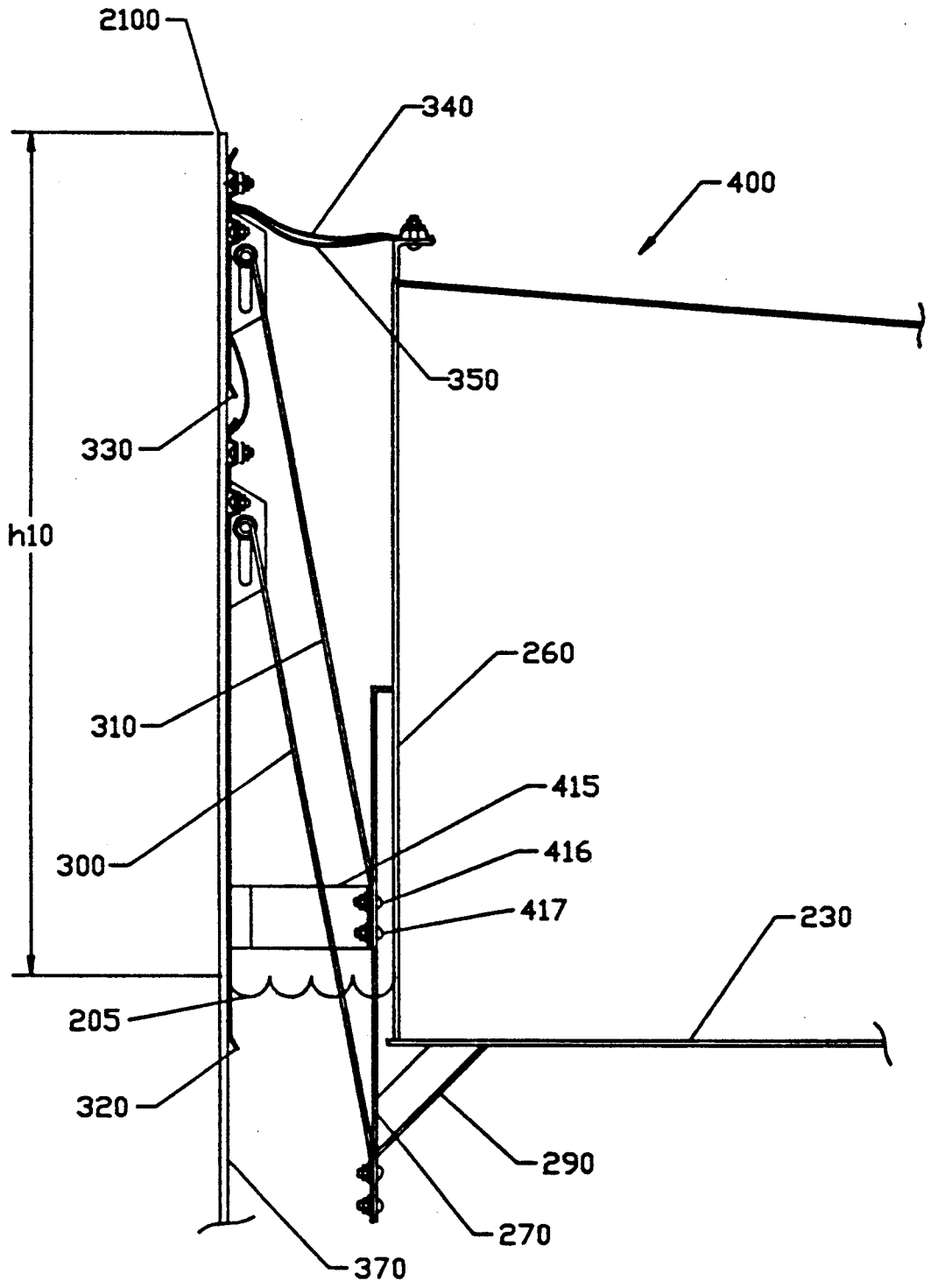
FIG. 4 is a cross sectional view of the space saving double seal applied to a pontoon type floating roof.

Referring next to FIG. 4 a pontoon type floating roof 400 is shown. Substantially all other details of the invention are the same as shown in FIG. 3. An open top external floating roof type tank 201 is shown. The top surface of the liquid is numbered 205. Height h10 is the same. An outer rim plate 260 supports a pusher brace 270. It should be noted that pusher brace 270 or pusher brace 27 of FIG. 3 could alternatively be supported directly off the bottom 230 of the floating roof 400 or 23 of FIG. 3. A brace 290 supports the spring pressure of pusher spring 300. Pusher spring 300 pushes lower shoe 320 against inner wall 370. Pusher spring 310 pushes upper shoe 330 against inner wall 370. Level 2100 is the uppermost limit of travel of the outer rim plate 260.

Primary and secondary vapor barriers 350, 340 are equivalent to 35,34 of FIG. 3. An optional horizontal spring 415 is attached to the pusher brace 270 by means of bolts 416, 417. Horizontal spring 415 helps hold the lower portion of lower shoe 320 against the inner wall 370.

Figure 5:
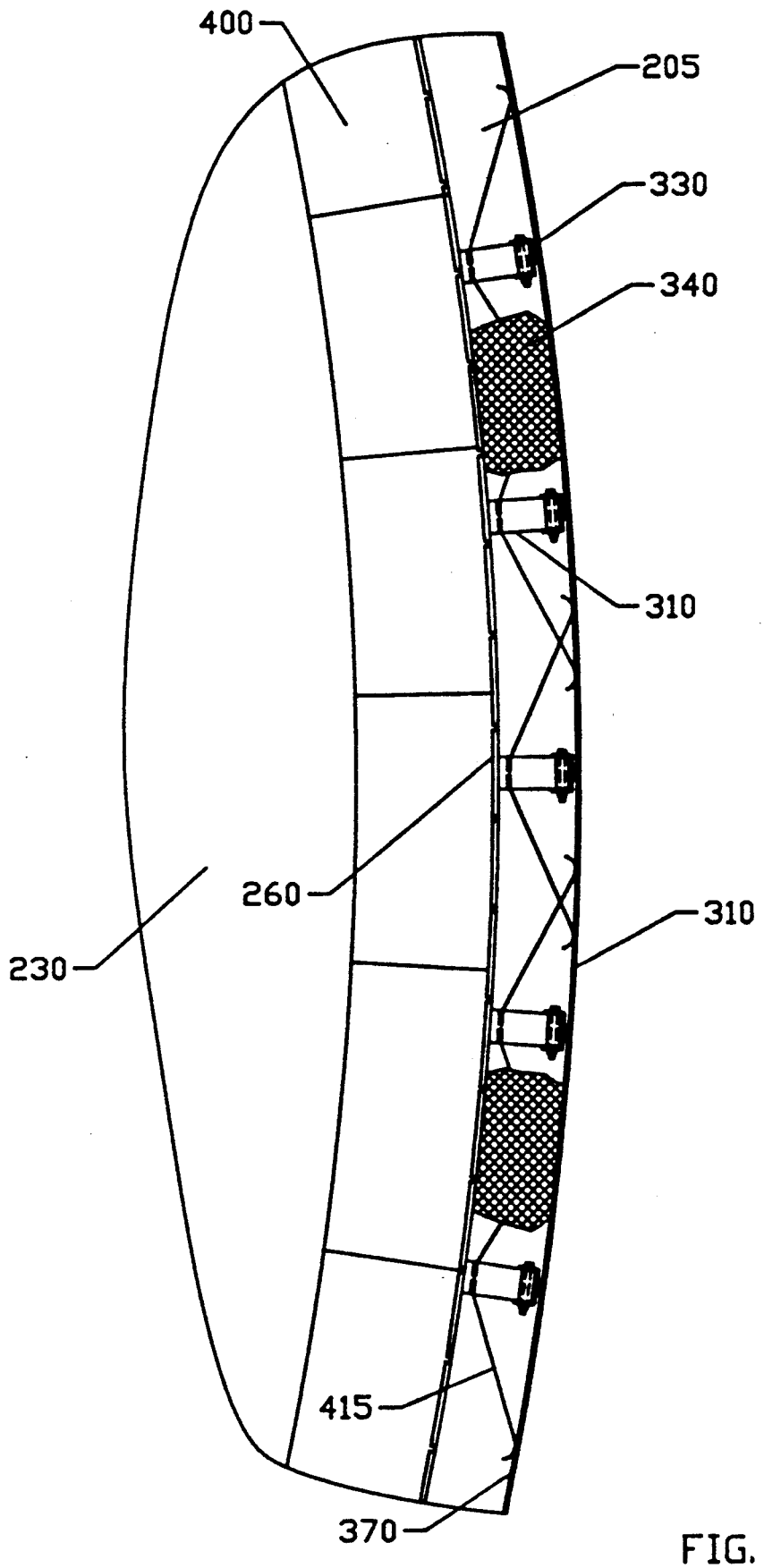
FIG. 5 is a top plan view of a single section of the space saving double seal shown in FIG. 4.

Referring next to FIG. 5 the pontoon type floating roof 400 of FIG. 4 is shown in a top plan view. There is a partial cutaway of the primary and secondary vapor barriers 350, 340.

Figure 6:
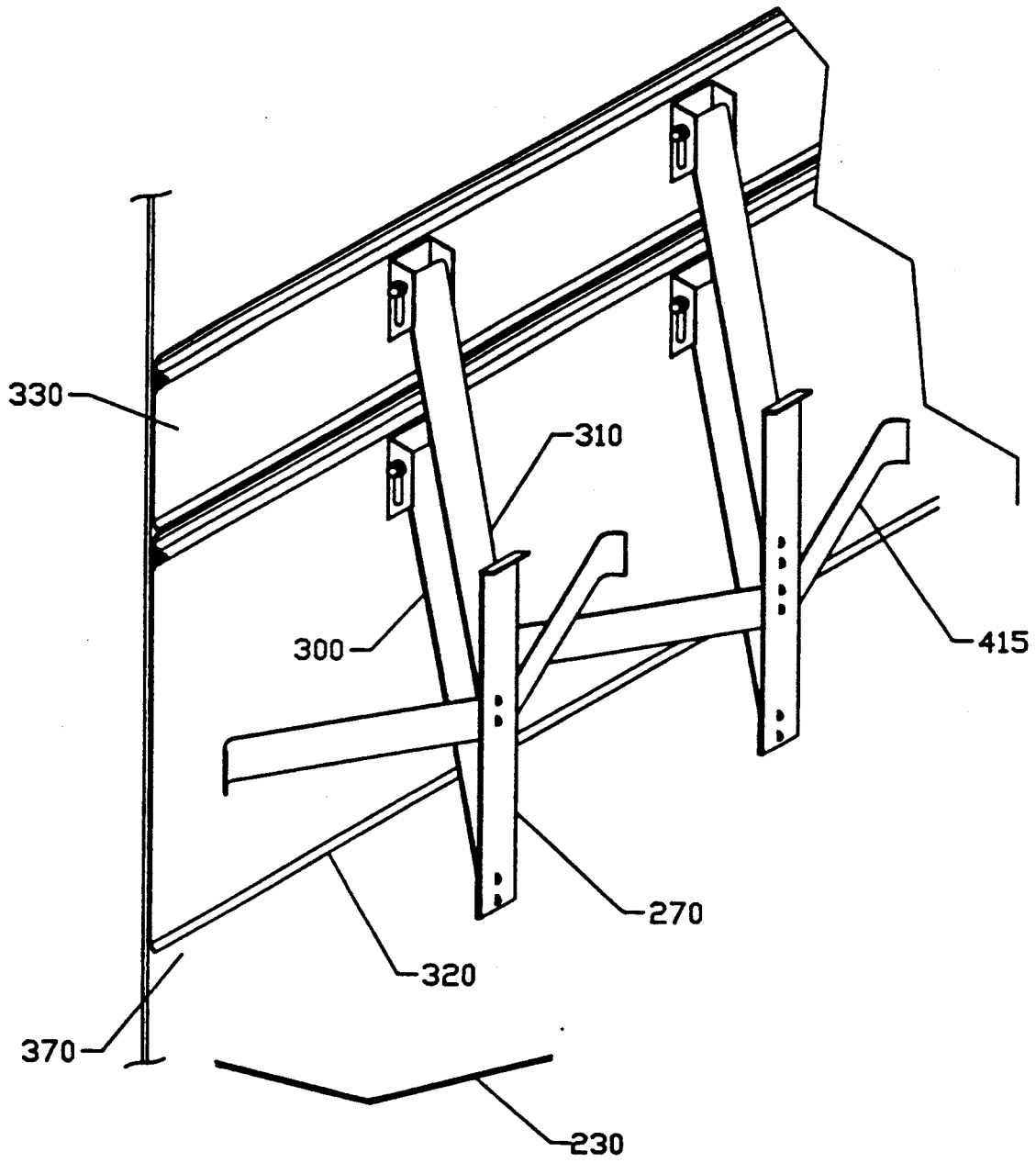
FIG. 6 is a top perspective view of the inside of the tank having the space saving double seal of FIG. 5.

Referring last to FIG. 6 the view shows a cutaway of the outer rim plate 260 of FIG. 4. The pusher brace 270 and all the metal members of the invention are shown. The vapor barriers 340, 350 have been deleted.

It should be noted that the present invention is totally applicable to open top as well as closed roof tanks.

Although the present invention has been described with reference to preferred embodiments, numerous modifications and variations can be made and still the result will come within the scope of the invention. No limitation with respect to the specific embodiments disclosed herein is intended or should be inferred.

I claim:

1. In a liquid storage tank having an inner wall and a floating roof having an outer periphery, a double seal comprising a plurality of sealing units spaced circumferentially about said periphery and each having:

an outer rim plate extending vertically from the outer periphery of the floating roof;

a pusher brace depending from the outer periphery of the floating roof;

a lower shoe slidingly engaged against the tank's inner wall;

spring means between said pusher brace and the lower shoe, thereby pushing the lower shoe against the inner wall;

an upper shoe slidingly engaged against the tank's inner wall; and spring means pushing the upper shoe against the inner wall;

said upper and lower shoes each further comprising a top and a bottom;

said double seal further comprising a primary sealing means extending from the outer rim plate to the lower shoe about said periphery; and secondary sealing means extending from the outer rim plate to the upper shoe about said periphery.

2. The double seal of claim 1 wherein said spring means between said pusher brace and the lower shoe further comprises a vertical spring extending between the top of the lower shoe and the bottom of the pusher brace.

3. The double seal of claim 1 wherein said spring means between said pusher brace and the lower shoe further comprises a horizontal spring extending between the middle of the pusher brace and the lower shoe.

4. The double seal of claim 1 wherein said spring means pushing the upper shoe against the inner wall further comprises a vertical spring extending between the top of the upper shoe and the middle of the pusher brace.

5. The double seal of claim 1 wherein said primary sealing means further comprises a vapor barrier extending from the top of the outer rim plate, behind the spring means pushing the upper shoe against the inner wall and attaching to the top of the lower shoe.

6. The double seal of claim 1 wherein said secondary sealing means further comprises a vapor barrier extending above the primary sealing means from the top of the outer rim plate to the top of the upper shoe.

7. A double seal apparatus for a floating roof having an outer rim plate vertically rising from its outer periphery, the floating roof floating on a liquid stored in a storage tank having an inner wall, the double seal apparatus comprising a plurality of sealing units spaced circumferentially about said periphery and each having:

a pusher brace depending from the outer periphery;

an upper shoe slidingly engaged with the inner wall;

spring means between the upper shoe and the pusher brace functioning to press the upper shoe against the inner wall;

a lower shoe slidingly engaged with the inner wall below the upper shoe; and spring means between the lower shoe and the pusher brace functioning to press the lower shoe against the inner wall;

said double seal further comprising a primary vapor barrier sealing means extending from said outer rim plate, past said upper shoe and affixed to said lower shoe about said periphery; and a secondary vapor barrier sealing means extending from said outer rim plate to said upper shoe about said periphery above said primary vapor barrier sealing means.

* * * * *